United States Patent [19]

Beck

[11] Patent Number: 4,515,219

[45] Date of Patent: May 7, 1985

[54] LOW PRESSURE RESPONSIVE DOWNHOLE TOOL WITH FLOATING SHOE RETARDING MEANS

[75] Inventor: Harold K. Beck, Duncan, Okla.

[73] Assignee: Halliburton Company, Duncan, Okla.

[21] Appl. No.: 533,901

[22] Filed: Sep. 19, 1983

[51] Int. Cl.[3] ..... E21B 34/10

[52] U.S. Cl. ..... 166/374; 166/323; 166/324

[58] Field of Search ..... 166/319, 332, 321, 324, 166/323, 334, 374, 373; 251/62

[56] References Cited

U.S. PATENT DOCUMENTS

| | | | |
|---|---|---|---|
| Re. 29,562 | 3/1978 | Wray et al. | 166/264 X |
| 2,740,479 | 4/1956 | Schwegman | 166/145 |
| 3,358,755 | 12/1967 | Chisholm | 166/3 |
| 3,431,985 | 3/1969 | Bowen | 173/119 |
| 3,526,278 | 9/1970 | Scott | 166/334 |
| 3,646,995 | 3/1972 | Manes et al. | 166/152 X |
| 3,664,415 | 5/1972 | Wray et al. | 166/264 X |
| 3,780,809 | 12/1973 | Ayers, Jr. et al. | 166/374 |
| 3,782,461 | 1/1974 | Watkins | 166/72 |
| 3,796,261 | 3/1974 | Nutter | 166/237 |
| 3,823,773 | 7/1974 | Nutter | 166/250 X |
| 3,842,913 | 10/1974 | Mott | 166/314 |
| 3,850,250 | 11/1974 | Holden et al. | 166/95 X |
| 3,856,085 | 12/1974 | Holden et al. | 166/264 |
| 3,858,649 | 1/1975 | Wray et al. | 166/264 X |
| 3,860,069 | 1/1975 | Wray et al. | 166/264 |
| 3,870,104 | 3/1975 | Mott | 166/208 X |
| 3,915,228 | 10/1975 | Giebeler | 166/321 |
| 3,930,540 | 1/1976 | Holden et al. | 166/95 |
| 3,964,305 | 6/1976 | Wray et al. | 73/151 |
| 3,964,544 | 6/1976 | Farley et al. | 166/264 X |
| 3,976,136 | 8/1976 | Farley et al. | 166/264 |
| 4,047,564 | 9/1977 | Nix et al. | 166/72 |
| 4,058,165 | 11/1977 | Holden et al. | 166/314 |
| 4,059,153 | 11/1977 | Nix et al. | 166/264 |
| 4,063,593 | 12/1977 | Jessup | 166/317 |
| 4,076,077 | 2/1978 | Nix et al. | 166/321 X |
| 4,109,724 | 8/1978 | Barrington | 166/321 X |
| 4,109,725 | 8/1978 | Williamson et al. | 166/321 X |
| 4,113,012 | 9/1978 | Evans et al. | 166/321 X |
| 4,144,937 | 3/1979 | Jackson et al. | 166/324 X |
| 4,341,266 | 7/1982 | Craig | 166/321 X |
| 4,448,254 | 5/1984 | Barrington | 166/373 |

OTHER PUBLICATIONS

"APR Ball Valve Tester", Halliburton Services Sales and Service Catalog—No. 39, pp. 3310–3311.

*Primary Examiner*—James A. Leppink
*Assistant Examiner*—Hoang C. Dang
*Attorney, Agent, or Firm*—James R. Duzan; Thomas R. Weaver

[57] ABSTRACT

An annulus pressure responsive downhole tool includes a housing having a power piston slidably disposed therein. First and second pressure conducting passages communicate a well annulus with first and second sides of the power piston. A retarding device is disposed in the second pressure conducting passage for delaying communication of a sufficient portion of an increase in well annulus pressure to the second side of the power piston for a sufficient time to allow a pressure differential across the power piston to move the power piston from a first position to a second position relative to the housing. The retarding device is an annular floating shoe having a large number of O-rings frictionally engaging inner and outer tubular members of said housing. A pressure relief valve is communicated with the second pressure conducting passage between the power piston and the retarding device for relieving from the second pressure conducting passage a volume of fluid sufficient to permit the power piston to travel to its second position. A spring biased pin disposed in the housing engages an indentation in an actuating mandrel attached to said power piston to releasably hold the power piston in its second position.

20 Claims, 8 Drawing Figures

LOW PRESSURE RESPONSIVE DOWNHOLE TOOL WITH FLOATING SHOE RETARDING MEANS

BACKGROUND OF THE INVENTION

1. Field of the Invention

The present invention relates to annulus pressure responsive downhole tools. Particularly, the present invention provides an improved design for an annulus pressure responsive downhole tool which eliminates the need for using a large volume of compressible liquid or a volume of compressible gas within the tool to compensate for the volume displaced by a power piston of the tool.

2. Description of the Prior Art

It is well known in the art that downhole tools such as testing valves, circulating valves and samplers can be operated by varying the pressure of fluid in a well annulus and applying that pressure to a differential pressure piston within the tool.

The predominant method of creating the differential pressure across the differential pressure piston has been to isolate a volume of fluid within the tool at a fixed reference pressure. Such a fixed reference pressure has been provided in any number of ways.

One manner of providing a fixed reference pressure is by providing an essentially empty sealed chamber on the low pressure side of the power piston, which chamber is merely filled with air at the ambient pressure at which the tool was assembled. Such a device is shown for example in U.S. Pat. No. 4,076,077 to Nix et al. with regard to its sealed chamber 42. This type of device does not balance hydrostatic annulus pressure across the power piston as the tool is run into the well.

Another approach has been to provide a chamber on the low pressure side of the piston, and fill that chamber with a charge of inert gas such as nitrogen. Then, when the annulus pressure overcomes the gas pressure, the power piston is moved by that pressure differential, and the gas compresses to allow the movement of the power piston. Such a device is shown for example in U.S. Pat. No. 3,664,415 to Wray et al. with regard to its nitrogen cavity 44. This type of device does not balance hydrostatic annulus pressure across the power piston as the tool is run into the well.

Another approach has been to use a charge of inert gas as described above, in combination with a supplementing means for supplementing the gas charge pressure with the hydrostatic pressure of the fluid in the annulus contained between the well bore and the test string, as the test string is lowered into the well. Such a device is shown for example in U.S. Pat. No. 3,856,085 to Holden et al. When a tool of this type has been lowered to the desired position in the well, the inert gas pressure is supplemented by the amount of the hydrostatic pressure in the well at that depth. Then, an isolation valve is closed which then traps in the tool a volume of well annulus fluid at a pressure substantially equal to the hydrostatic pressure in the well annulus at that depth. Once the isolation valve has closed, the reference pressure provided by the inert gas is no longer effected by further increases in well annulus pressure. Then well annulus pressure may be increased to create a pressure differential across the power piston to actuate the tool.

Also, rather than utilize a compressible inert gas such as nitrogen within such tools, it has been proposed to use a large volume of a somewhat compressible liquid such as silicone oil on the low pressure side of the piston. Such a device is seen for example in U.S. Pat. No. 4,109,724 to Barrington.

One recent device which has not relied upon either a large volume of compressible liquid or a volume of compressible gas is shown in U.S. Pat. No. 4,341,266 to Craig. This is a trapped reference pressure device which uses a system of floating pistons and a differential pressure valve to accomplish actuation of the tool. The reference pressure is trapped by a valve which shuts upon the initial pressurizing up of the well annulus after the packer is set. The Craig tool does balance hydrostatic pressure across its various differential pressure components as it is run into the well.

Another relatively recent development is shown in U.S. Pat. No. 4,113,012 to Evans et al. This device utilizes fluid flow restrictors 119 and 121 to create a time delay in any communication of changes in well annulus pressure to the lower side of its power piston. During this time delay the power piston moves from a first to a second position. The particular tool disclosed by Evans et al. utilizes a compressed nitrogen gas chamber in combination with a floating shoe which transmits the pressure from the compressed nitrogen gas to a non-compressible liquid filled chamber. This liquid filled chamber is communicated with a well annulus through pressurizing and depressurizing passages, each of which includes one of the fluid flow restrictors plus a back pressure check valve. Hydrostatic pressure is balanced across the power piston as the tool is run into the well, except for the relatively small differential created by the back pressure check valve in the pressurizing passage.

With most of these prior art devices, there has been the need to provide either a large volume of compressible liquid or a volume of compressible gas to account for the volume change within the tool on the low pressure side of the power piston. This compressible liquid or gas has generally either been silicone oil or nitrogen. There are disadvantages with both of these.

When utilizing a tool which provides a sufficient volume of compressible silicone oil to accommodate the volume change required on the low pressure side of the power piston, the tool generally becomes very large because of the large volume of silicone oil required in view of its relatively low compressibility.

On the other hand, there is a danger in tools that utilize an inert gas, such as nitrogen, as in any high pressure vessel.

Furthermore, most of these prior art tools have required relatively high annulus pressure increases, sometimes as high as 2000 psi, for operation.

SUMMARY OF THE INVENTION

The present invention provides a very much improved annulus pressure responsive tool which operates in response to a relatively low increase in annulus pressure, and which also eliminates the problems of dealing with either a large volume of compressible liquid or a pressurized volume of compressible gas in order to provide for the volume change on the low pressure side of the moving power piston.

The present invention provides an annulus pressure responsive downhole tool apparatus which includes a tool housing having a power piston slidably disposed in the housing. A first pressure conducting passage communicates the well annulus with a first side of the power piston. A second pressure conducting passage communicates the well annulus with a second side of the power piston.

A retarding means, is disposed in the second pressure conducting passage for delaying communication of a sufficient portion of an increase in well annulus pressure to the second side of the power piston for a sufficient time to allow a pressure differential from the first side to the second side of the power piston to move the power piston from a first position to a second position relative to the housing. The retarding means is an annular floating shoe having a large number of O-rings frictionally engaging inner and outer tubular members of said housing.

A pressure relief means is communicated with the second pressure conducting passage, between the second side of the piston and the retarding means, for relieving from the second pressure conducting passage a volume of fluid sufficient to permit the power piston to travel to its second position.

A spring biased pin disposed in the housing engages an indentation in an actuating mandrel attached to the power piston to releasably hold the power piston in its second position.

It is the pressure relief means, which relieves fluid from the low pressure side of the power piston, which eliminates the need for using either a compressible gas or a large volume of compressible liquid on the low pressure side of the power piston.

The use of the pressure relief means to accommodate the fluid displaced by the power piston, instead of using a large volume of compressible liquid or a pressurized volume of gas provides a number of advantages.

Since no pressurized nitrogen is used, the dangers associated with the use of pressurized nitrogen are eliminated.

Very significantly, the pressures which must be applied to the well annulus to operate the tools of the present invention are very much reduced as compared to most prior art tools.

Also, the present invention provides a tool which always actuates at the same differential operating pressure. Tools which rely upon compressible liquids or compressible gas do not have constant differential operating pressures because the compressibility of the silicone oil and the nitrogen is non-linear.

The tools of the present invention can be operated with a differential operating pressure of as little as 200–500 psi. This is determined by the strength of the return spring located below the power piston. Thus, if an actual well annulus pressure increase of 1000 psi is used to actuate the tool of the present invention, a wide margin of error is provided assuring that the tool will in fact be actuated.

Prior art tools, particularly those relying upon the compression of silicone oil, require much higher differential operating pressures as high as 2000 psi.

This is particularly important in view of the fact that, assuming the tool in question is a tester valve, the other tools in the test string, such as circulating valves for example, have to be set to operate at a differential operating pressure greater than that of the tester valve. Typically, it is undesirable to increase the well annulus pressure greater than about 3000 psi because of limits on the strength of the well casing. The present invention, therefore, allows the differential operating pressures of the various tools in the testing string to be spaced further apart, and also generally allows those pressures to be decreased. This improves both the safety and the reliability of operation of the entire testing string.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
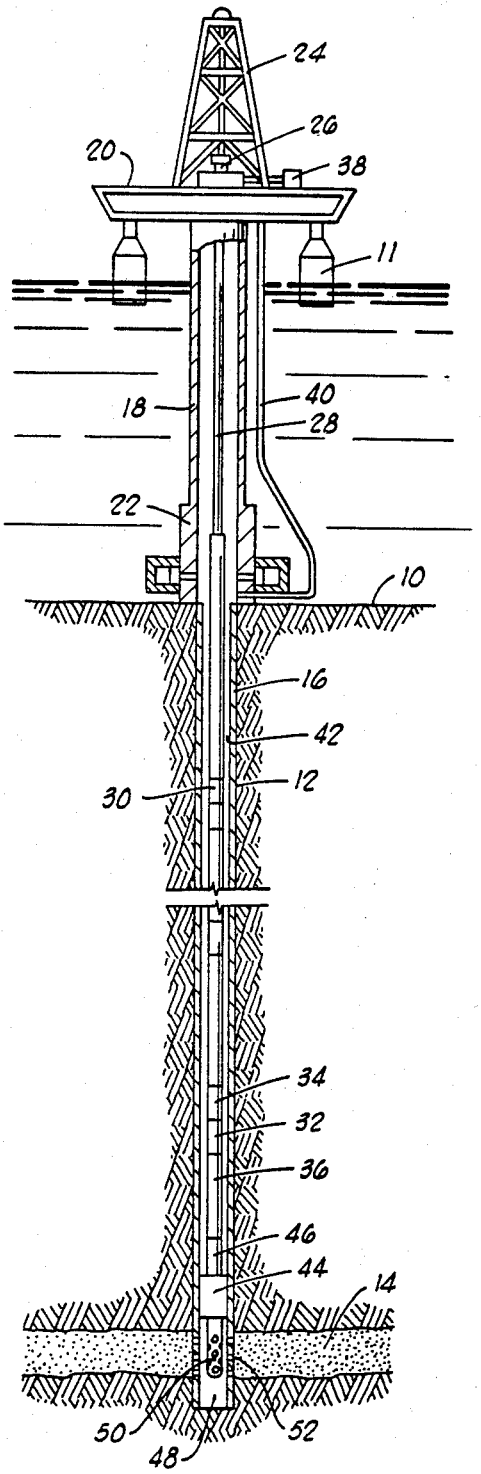
FIG. 1 is a schematic elevation view of an offshore well showing a well test string in place within the well bore.

Referring now to the drawings, and particularly to FIG. 1, the downhole tool of the present invention is shown in a testing string for use in an offshore oil or gas well.

In FIG. 1, a floating work station 11 is centered over a submerged oil or gas well located in the sea floor 10 having a bore hole 12 which extends from the sea floor 10 to a submerged formation 14 which is to be tested. The bore hole 12 is typically lined by a steel liner or casing 16 which is cemented into place.

A subsea conduit 18 extends from a deck 20 of the floating work station 11 into a well head installation 22. The floating work station 11 has a derrick 24 and hoisting apparatus 26 for raising and lowering tools to drill, test and complete the oil or gas well.

A testing string 28 is shown after it has been lowered into the bore hole 12 of the oil or gas well. The testing string 28 includes such tools as a slip joint 30 to compensate for the wave action of the floating work station 11 as the testing string 28 is being lowered into place, a tester valve 32 and a circulation valve 34. Also, a check valve assembly 36 may be located in the testing string 28 below the tester valve 32.

The tester valve 32, circulation valve 34, and check valve assembly 36, are operated by fluid annulus pressure exerted by a pump 38 located on the deck 20 of the floating work station 11. Pressure changes are transmitted by a pipe 40 to a well annulus 42 between the casing 16 and the testing string 28.

Annulus pressure in the well annulus 42 is isolated from the formation 14 to be tested by a packer 44 set in the well casing 16 just above the formation 14.

The testing string 28 also generally includes a tubing seal assembly 46 which stabs through a passageway through the production packer 44 forming a seal isolating an upper portion of the well annulus 42 above the packer 44 from an interior bore 48 of the well immediately adjacent the formation 14 and below the packer 44. The interior bore 48 may also be referred to as a lower portion of the well annulus 42 below the packer 44, it being understood that this lower portion 48 of the well annulus 42 is not necessarily annular in shape, but instead includes whatever portion of the well cavity there is below the packer 44.

A perforated tail piece 50, or other production tube, is located at the bottom end of the seal assembly 46 to allow formation fluids to flow from the formation 14 into a flow passage of the testing string 28. Formation fluid is admitted into the lower portion 48 of well annulus 42 through perforations 52 provided in the casing 16 adjacent the formation 14.

A testing string such as that illustrated may be used either to test formation flow from the formation 14, or treat the formation 14 by pumping liquids downward through the test string into the formation 14.

The present invention relates to low pressure responsive tools for use in such a test string.

The specific embodiment illustrated in the drawings and discussed below relates to a tester valve which would be located such as the tester valve 32 in the schematic illustration of FIG. 1.

The scope of the present invention, however, is such that it embodies more than just tester valves, and embodies any downhole tool apparatus which is operated in response to annulus pressure.

Thus the concepts about to be discussed can be utilized for tester valves, circulation valves, such as circulation valve 34 illustrated in FIG. 1, or also for example in sample chambers or the like which might be used with such a test string to trap a sample of the flowing fluid.

DESCRIPTION OF THE PREFERRED EMBODIMENT OF FIGS. 2A–2G

Referring now to FIGS. 2A–2G, an elevation half-section view is thereshown of the tester valve of the present invention, which tester valve is generally designated by the numeral 32. The tester valve 32 may generally be referred to as an annulus pressure responsive downhole tool apparatus 32.

The tester valve 32 includes a tool housing generally designated by the numeral 54. The tool housing 54 includes an upper adaptor 56, a valve housing section 58, a first middle adaptor 60, a power housing section 612, a second middle adaptor 614, an intermediate housing section 616, a third middle adaptor 618, a retarding shoe housing section 620, and a lower adaptor 622.

An O-ring seal 70 is provided between upper adaptor 56 and valve housing section 58.

Valve housing section 58 and first middle adaptor 60 are joined at threaded connection 72 and a seal is provided therebetween by O-ring 74.

First middle adaptor 60 and power housing section 612 are joined together at threaded connection 76 and a seal is provided therebetween by O-ring 78.

Second middle adaptor 614 has its upper end threadedly connected to power housing section 612 at threaded connection 624 with a seal provided therebetween by double O-ring sealing means 626.

Second middle adaptor 614 has its lower end threadedly connected to intermediate housing section 616 at threaded connection 628 with a seal provided therebetween by double O-ring sealing means 630.

Intermediate housing section 616 has its lower end threadedly connected to third middle adaptor 618 at threaded connection 632 with a seal being provided therebetween by O-ring 634.

Third middle adaptor 618 has its lower end threadedly connected to retarding shoe housing section 620 at threaded connection 636 with a seal being provided therebetween by O-ring 638.

Retarding shoe housing section 620 has its lower end threadedly connected to lower adaptor 54 at threaded connection 640.

Disposed in the valve housing section 58 is a full opening ball valve means 90.

Figure 2A:
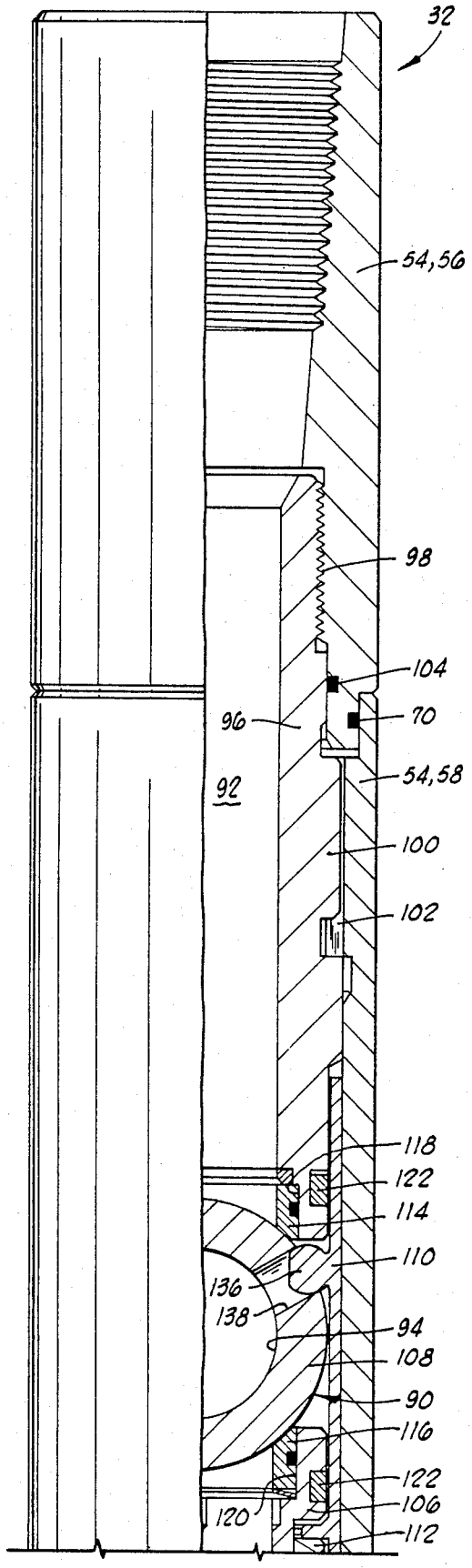
FIGS. 2A–2G comprise an elevation half-section view of the downhole tool of the present invention.

The ball valve means 90 is illustrated in FIG. 2A in its first closed position closing a central bore 92 of the tester valve 32. The ball valve means 90 may be rotated 90° relative to the housing 54 to an open position wherein a bore 94 of ball valve means 90 is aligned with central bore 92.

The ball valve means 90 includes an upper valve support 96 which is threadedly connected to upper adaptor 56 at threaded connection 98. Radially outwardly extending splines 100 of upper valve support 96 are engaged with radially inwardly extending splines 102 of valve section housing 58 to prevent relative rotation between those members. An O-ring seal 104 is provided between upper adaptor 56 and upper valve support 96.

Ball valve means 90 also includes a lower valve support 106, a ball 108, ball valve actuating arms 110 (only one of which is shown) and an actuating sleeve 112.

Upper and lower valve seats 114 and 116 are received within counterbores 118 and 120, respectively, of upper and lower valve supports 96 and 106. C-clamps 122 bias the upper and lower valve supports 96 and 106 toward each other so that the seats 114 and 116 are held in close engagement with the ball 108.

Figure 2B:
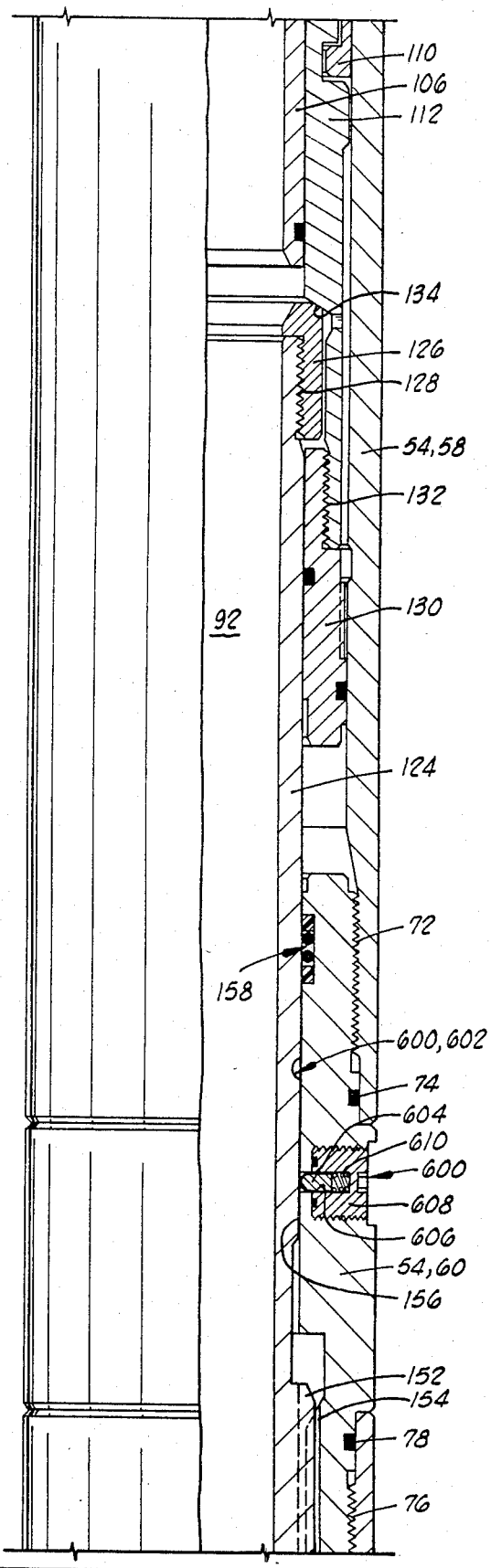

Referring now to FIG. 2B, a ball valve actuating mandrel 124 has its upper end received within actuating sleeve 112. An upper end collar 126 is threadedly connected to ball valve actuating mandrel 124 at threaded connection 128. A lower end collar 130 is threadedly connected to the lower end of actuating sleeve 112 at threaded connection 132 so that upper end collar 126 is trapped between lower end collar 130 and a downward facing shoulder 134 of actuating sleeve 112.

Thus, when ball valve actuating mandrel 124 is moved downward from the position illustrated in FIG. 2B, it pulls actuating sleeve 112 and ball valve actuating arms 100 downward relative to housing 54 so that a lug 136 of each ball valve actuating arm 110 which is received within a eccentric hole 138 of ball 108 causes the ball 108 to be rotated through an angle of 90° so that its bore 94 is aligned with the central bore 92 of the tester valve 32.

Figure 2C:
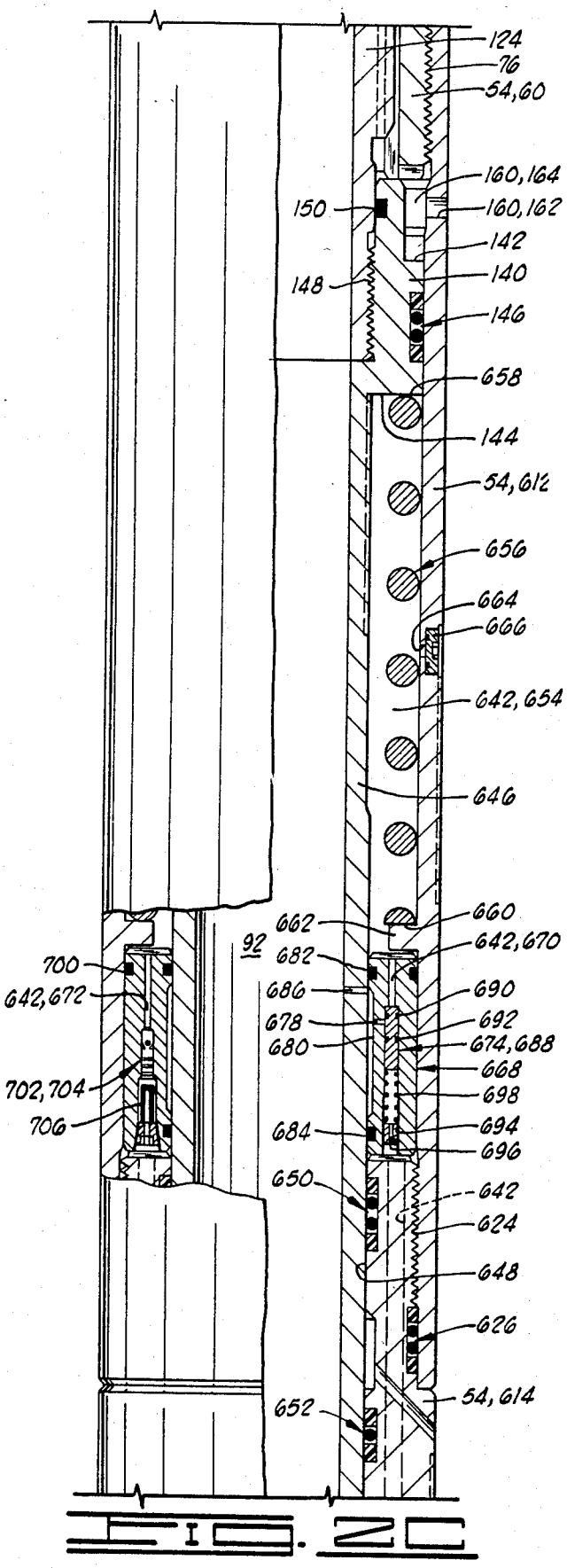

Referring now to FIG. 2C, a power piston 140 is slidably disposed in power housing section 612. Power piston 140 has a first side 142 and a second side 144. A double O-ring sliding seal means 146 is provided between power piston 140 and power housing section 612.

The ball valve actuating mandrel 124 is threadedly connected to power piston 140 at threaded connection 148 and O-ring seal 150 is provided therebetween.

Ball valve actuating mandrel 124 includes a plurality of radially outward extending splines 152 which engage radially inwardly extending splines 154 of first middle adaptor 60 to prevent relative rotation therebetween.

An intermediate portion of ball valve actuating mandrel 124, seen in FIG. 2B, is closely received within a bore 156 of first middle adaptor 60 and a double O-ring sliding seal means 158 is provided therebetween.

Referring again to FIG. 2B, a releasable holding means 600 is shown.

The releasable holding means 600 includes an indentation 602 disposed in the ball valve actuating mandrel 124. This ball valve actuating mandrel 124 is threadedly attached to the power piston 140 at threaded connection 148 as seen in FIG. 2C.

The releasable holding means 600 also includes a holding pin 604 which is radially slidably disposed in a radial bore 606 of the first middle adaptor section 60 of tool housing 54. The radial bore 606 is actually partially disposed in the first middle adaptor 60 and partially disposed in a threaded holding insert 608.

Releasable holding means 600 also includes a resilient pin biasing means 610, which is a coil compression spring 610, for biasing the holding pin 604 radially inward relative to the first middle adaptor 60 of tool housing 54.

The indentation 602 and holding pin 604 are so arranged and constructed that when the power piston 140 is moved downward to its second position, the indentation 602 is radially aligned with the holding pin 604 so that the holding pin 604 is moved into the indentation 602 by the pin biasing means 610 so that the power piston 140 is then releasably held in its second position.

Thus, the releasable holding means 600 may generally be described as a releasable holding means 600, operatively associated with the power piston 140, for releasably preventing the power piston 140 from returning to its first position.

As is further explained below, the releasable holding means 600 actually provides only a portion of the force necessary to hold the power piston 140 in its second position. The remainder of the necessary force is provided by a downward pressure differential maintained across power piston 140.

Disposed in the tester valve apparatus 32 is a first pressure conducting passage means 160 for communicating the well annulus 42 (see FIG. 1) with first side 142 of power piston 140. First pressure conducting passage means 160 includes a power port 162, and thus may be referred to as power passage means 160. First pressure conducting passage means 160 also includes an annular cavity 164 defined between power housing section 612 and the combined power piston 140 and ball valve actuating mandrel 124.

A second pressure conducting passage means 642 communicates the well annulus 42 with the second side 144 of power piston 140, and includes a balancing port 644 (see FIG. 2G) and a plurality of passages and cavities further described below.

Extending downward from power piston 140 is a guide mandrel means 646 which has its lower end portion closely and slidably received within an upper counterbore 648 of second middle adaptor 614. A sliding seal is provided therebetween by first and second seal means 650 and 652.

An annular cavity 654 is defined between guide mandrel means 646 and power housing section 612, and forms a part of the second pressure conducting passage means 642.

Disposed in an upper portion of annular cavity 654 is a resilient biasing means 656, which is a coil compression spring 656, operatively associated with the power piston 140 for biasing the power piston 140 toward its first position. The coil spring 656 has its upper end 658 engaging the second side 144 of power piston 140 and has its lower end 660 engaging a radially inward extending annular ledge 662 of power housing section 612.

As is further explained below, coil spring 656 is strong enough to overcome the holding force of releasable holding means 600, alone.

A filler port 664 is disposed through power housing section 612 and is closed by a threaded seal plug 666. The filler port 664 is utilized when filling the annular cavity 654 with oil.

Disposed in a lower portion of annular cavity 654 is an annular relief cartridge 668.

Relief cartridge 668 has first and second cartridge passages 670 and 672 disposed therethrough, which cartridge passages comprise a portion of second pressure conducting passage means 642.

A pressure relief means 674 is disposed in the first cartridge passage 670 for relieving from a first portion of the second pressure conducting passage means 642 a volume of fluid sufficient to permit the power piston 140 to travel to its second position. This first portion of the second pressure conducting passage means 642 is defined as the portion of the second pressure conducting passage means 642 between the second side 144 of power piston 140 and an annular sliding shoe-type retarding means 676 which is further described below. This first portion of the second pressure conducting passage means is preferably filled with a somewhat compressible liquid such as silicone oil.

Pressure relief means 674 is disposed in the pressure relief cartridge 668, which in the context of the present discussion may be referred to as a relief housing 668. A relief port 678 is disposed through the relief housing 668 and communicates with a longitudinal groove 680 disposed in the inner cylindrical surface of relief housing 668 between upper and lower internal seals 682 and 684.

Longitudinal groove 680 communicates with a dump passage 686 disposed through the guide mandrel means 646. The dump passage 686 communicates with the dump zone 92 which is also the central bore of the tester valve 32.

A pressure relief piston means 688 is slidably disposed in the first cartrige passage 670 of relief housing 668 and is movable between a first position illustrated in FIG. 2C wherein the relief port 678 is closed, and a second downwardly displaced position wherein the relief port 678 is open.

Upper and lower O-ring seals 690 and 692 seal between the pressure relief piston means 688 and the cartridge passage 670.

A lower insert 694 is threadedly received in first cartridge passage 670 and has a longitudinal bore 696 therethrough.

A resilient relief piston biasing means 698, which is a coil compression spring 698, has its upper end engaging the lower end of pressure relief piston means 688 and has its lower end engaging the threaded insert 694. The compression load on the biasing means 698 may be adjusted by varying the threaded engagement of the insert 694 with the pressure relief cartridge 668.

An external seal 700 is provided between pressure relief cartridge 668 and an inner cylindrical surface of power housing section 612.

Illustrated on the left-hand side of FIG. 2C, is a run-in balance means 702 for allowing well annulus pressure to sufficiently balance across power piston 140 as the tester valve 32 is run into a well so that a pressure differential from the first side 142 to the second side 144 of power piston 140 is never sufficient to overcome the resilient biasing means 656 and prematurely move the power piston 140 to its second position as the tester valve 32 is being run into a well.

This run-in balance means 702 includes the second cartridge passage 672 which may also be referred to as a bypass portion 672 of the second pressure conducting passage means 642.

Run-in balance means 702 also includes a one-way check valve 704 disposed in the bypass portion or second cartridge passageway 672 for allowing fluid flow and thus pressure transmission in a first upward direction from the well annulus through the bypass portion 672 of the second pressure conducting passage means 642 to the second side 144 of power piston 140, and for preventing fluid flow in a reverse downward direction opposite said first direction.

Also illustrated in FIG. 2C is a filter 706 located below the check valve 704 for preventing contaminated materials from interferring with the operation of the check valve 704.

Figure 2D:
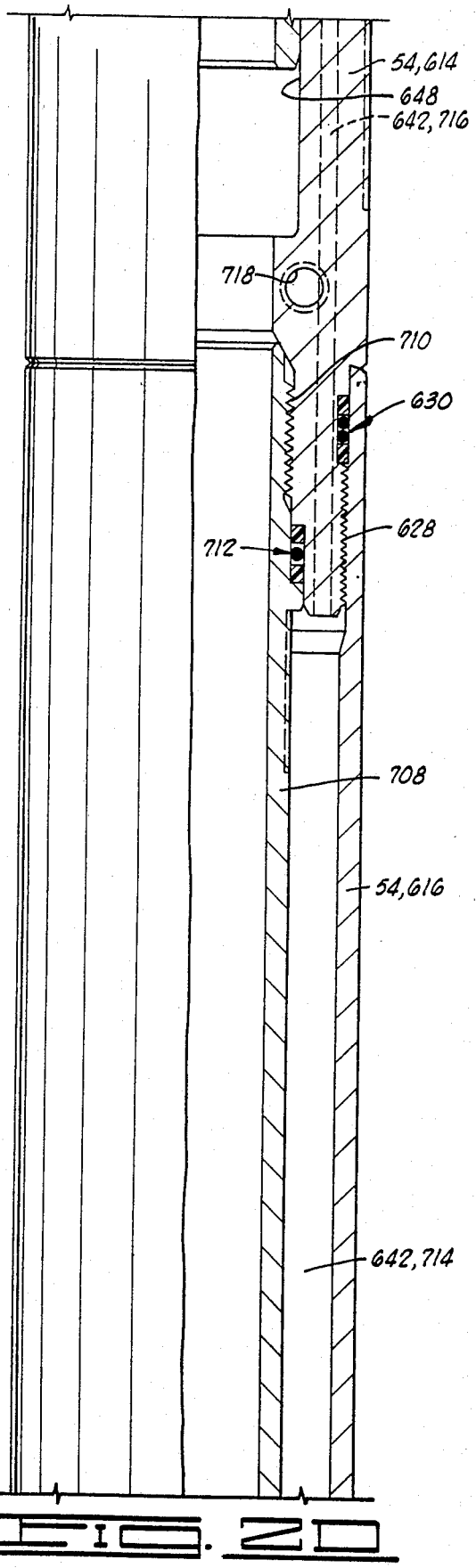

Referring now to FIG. 2D, an intermediate inner mandrel 708 has its upper end threadedly connected to an internal threaded portion of second middle adaptor 614 at threaded connection 710 with a seal being provided therebetween by O-ring seal means 712.

An annular cavity 714 is defined between intermediate inner mandrel 708 and intermediate housing section 616 and forms a part of the second pressure conducting passage means 642.

Second middle adaptor 614 has one or more longitudinal bores or passages 716 disposed through the length thereof communicating annular cavity 714 with annular cavity 654. The longitudinal passages 716 also comprise a part of the second pressure conducting passage means 642.

A transverse bore 718 is disposed through the body of second middle adaptor 614 and intersects the longitudinal bore 716. A filler valve (not shown) is disposed in transverse bore 718 for aid in filling the second pressure conducting passage means 642 with oil.

Figure 2E:
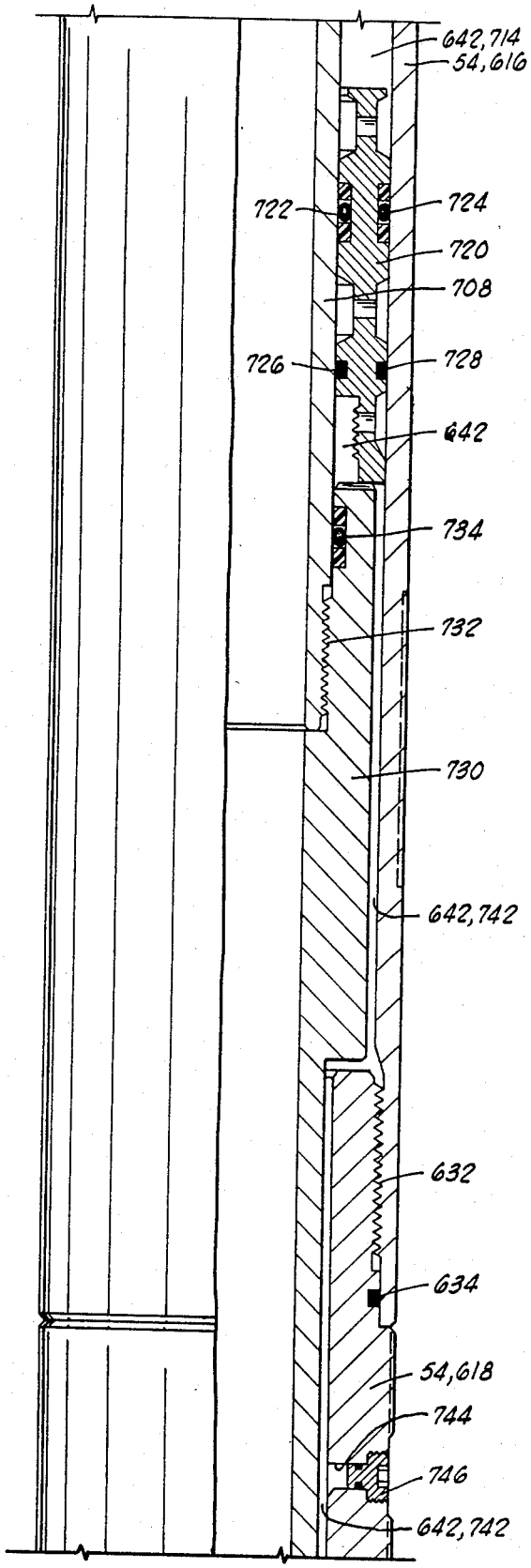
Figure 2F:
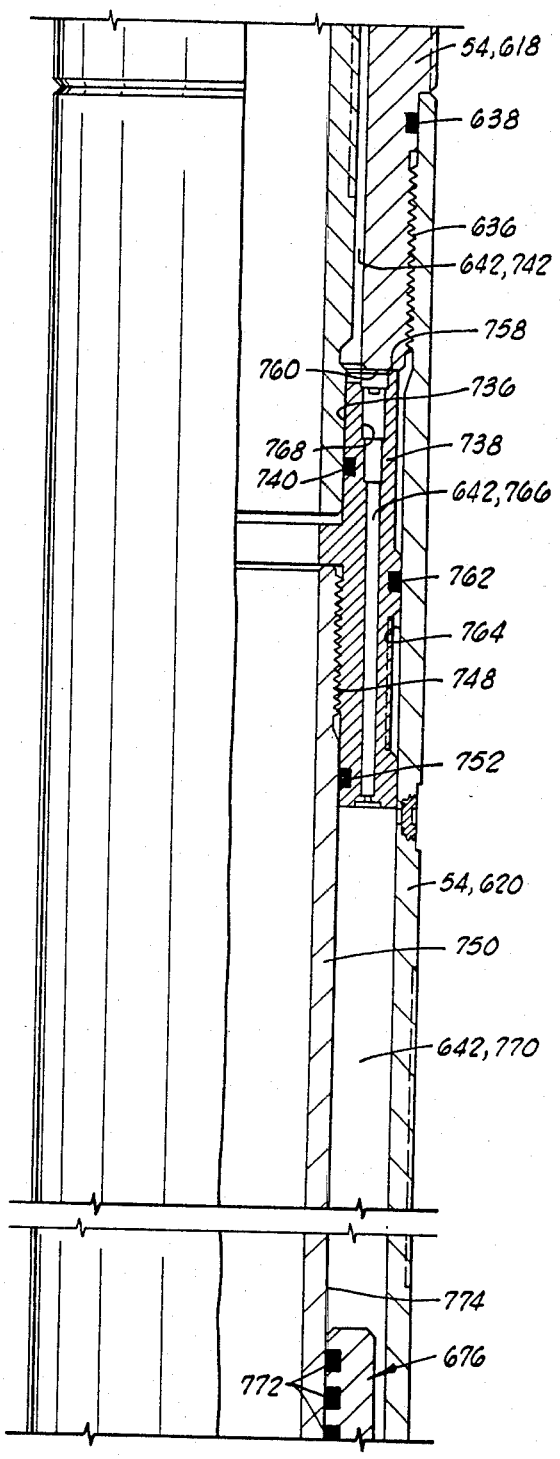
Figure 2G:
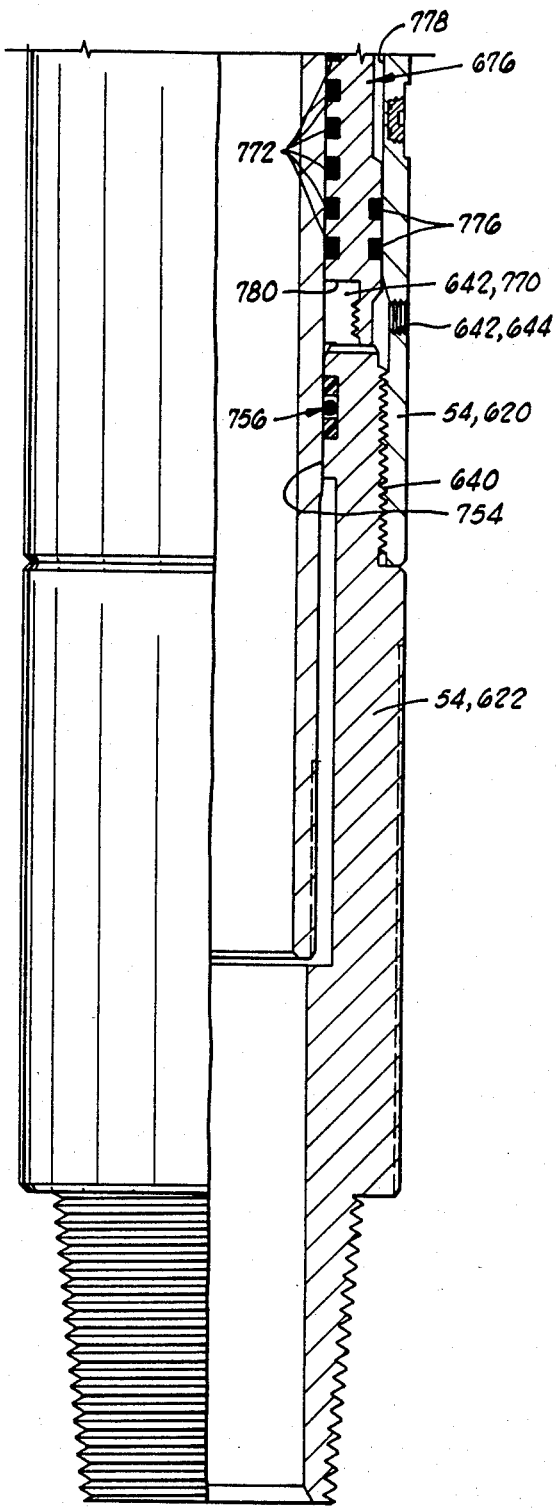

Referring now to FIG. 2E, an intermediate floating shoe 720 is disposed in an annular cavity 714. It includes inner and outer upper seals 722 and 724 sealing against intermediate inner mandrel 708 and intermediate housing section 616, respectively. It also includes inner and outer lower seals 726 and 728 sealing against intermediate inner mandrel 708 and intermediate housing section 616, respectively.

A mandrel extension 730 has its upper end threadedly connected to intermediate inner mandrel 708 at threaded connection 732 with a seal being provided therebetween by O-ring seal means 734.

Mandrel extension 730 has its lower end closely received within an upper counterbore 736 of a blank cartridge 738 which is located within the retarding shoe housing section 620. An annular seal is provided therebetween by O-ring seal 740.

An irregular annular cavity 742 is defined between mandrel extension 730 and both the lower portion of intermediate housing section 616 and an inner surface of third middle adaptor 618. The irregular annular cavity 742 has its upper end communicated with the annular cavity 714 and forms a portion of the second pressure conducting passage means 642.

A filler port 744 is disposed through third middle adaptor 618 and communicated with annular cavity 742. Filler port 744 is closed by a sealed threaded plug 746.

The blank adaptor 738 is threadedly connected at threaded connection 748 to the upper end of a lower inner mandrel 750 with a seal being provided therebetween by O-ring seal 752.

The lower inner mandrel 750 has a lower portion thereof closely received within an upper bore 754 of lower adaptor 622 with a seal being provided therebetween by O-ring seal means 756.

An upper end 758 of blank cartridge 738 abuts a lower end 760 of third middle adaptor 618. An annular O-ring seal 762 seals between the outer surface of blank adaptor 738 and an inner cylindrical surface 764 of retarding shoe housing section 620.

Blank cartridge 738 has a blank cartridge passageway 766 disposed therethrough. The passageway 766 is constructed so that it has an enlarged counterbore 768 at its upper end which is constructed so that it could receive a fluid restrictor of the type having a reduced diameter orifice for restricting fluid flow therethrough. Nevertheless, in the preferred arrangement of the present embodiment, there is no fluid restrictor in the blank cartridge 738 and its cartridge passageway 766 merely serves as an unrestricted flow passage of the second pressure conducting passage means 642, and is communicated at its upper end with the irregular annular cavity 742. The blank cartridge 738, however, does provide the option of adding a fluid restrictor to the tester valve 32 to supplement the action of the annular sliding shoe retarding means 676 which is further discussed below. Such a fluid restrictor would provide an additional time delay in communicating changes in well annulus pressure to second side 144 of power piston 140.

An annular cavity 770 is defined between the lower inner mandrel 750 and retarding shoe housing section 620 and forms a part of the second pressure conducting passage means 642.

The annular sliding shoe retarding means 676 is received within the annular cavity 770. Annular sliding shoe retarding means 676 provides a means for delaying communication of a sufficient portion of an increase in well annulus pressure to the second side 144 of power piston 140 for a sufficient time to allow a pressure differential from the first side 142 to the second side 144 of power piston 140 to move power piston 140 from a first position to a secod position relative to the tool housing 54.

The annular sliding shoe retarding means 676 is an annular floating shoe which is received within the annular cavity 770. It includes an inner resilient friction means 772 comprised of eight O-rings 772 which snugly and slidingly engage an outer cylindrical surface 774 of lower inner mandrel 750.

The annular sliding shoe retarding means 676 also includes outer resilient friction means 776 comprised of two O-rings snugly and slidingly engaging an inner cylindrical surface 778 of retarding shoe housing section 620.

The annular sliding shoe retarding means 676 provides a time delay in the communication of an increase or decrease in well annulus pressure to the second side 144 of power piston 140. This is accomplished in the following manner.

Although floating shoes are used in a large number of devices, those floating shoes are generally used for the purpose of dividing two fluids in a fluid passageway. An example of such typical sliding shoes would be the intermediate sliding shoe 720 illustrated in FIG. 2E which has two inner O-ring seals and two outer O-ring seals. In such typical types of annular floating shoes which are found throughout the prior art, the seals on the inner and outer surfaces of the annular shoe are merely for the purpose of providing a sliding seal between the annular shoe and the two cylindrical surfaces defining the annular cavity in which it slides. Although there is of course some friction between such an annular shoe and the cylindrical walls defining the annular cavity in which it fits, that friction is minimal and there is no significant time delay in the transmission of fluid pressure across the annular shoe.

The annular floating shoe retarding means 676 of the present invention, on the other hand, has a large number of O-ring seals 772 sealing with the lower inner mandrel 750, which number is greatly in excess of the number needed to provide a satisfactory seal with that lower inner mandrel 750.

Typically, no more than two O-rings such as the outer O-rings 776 are needed to provide a satisfactory seal between an annular floating shoe and a cylindrical member which it engages.

Thus, those O-rings 772 on the inside of annular floating shoe retarding means 676 in excess of two O-rings, are provided for the purpose of increasing the frictional resistance to movement of the annular floating shoe 676 relative to the lower inner mandrel 750.

By varying the number and the tightness of the inner O-rings 772, the amount of time delay provided by the annular floating shoe retarding means 676 can be varied.

The annular floating shoe retarding means 676 additionally functions in much the same manner as a back pressure check valve in that it prevents a certain portion of the increase or decrease in annulus fluid pressure from ever being communicated to the second side 144 of power piston 140.

When an increase in annulus fluid pressure is applied to the annulus fluid in the well annulus 42, that increase is communicated through balancing port 644 to a lower side 780 of annular floating shoe retarding means 676. Due, however, to the frictional engagement of the multitude of inner O-rings 772 with the lower inner mandrel 750, the annular floating shoe retarding means 676 does not immediately move upward so as to transmit that increase in fluid pressure to the fluid above it in annular cavity 770. Instead, that movement occurs slowly thus providing a time delay in the transmission of that increase in annulus fluid pressure to the second side 144 of power piston 140.

Also, the annular floating shoe retarding means 676 allows an additional portion of the increase in well annulus pressure to be communicated to the second side 144 of power piston 140 after the power piston 140 moves to its second position. This occurs because the power piston 140 moves to its second position much quicker than the annular floating shoe retarding means 676 can move in response to the increase in well annulus pressure. Thus, after the power piston 140 moves to its second position, the annular floating piston retarding means 676 continues to move upward due to the upward pressure differential thereacross until that upward pressure differential becomes too small to overcome the frictional resistance of the inner O-rings 772.

Since the entire increase in well annulus pressure is never communicated to second side 144 of power piston 140, a downward pressure differential will be maintained across power piston 140 so long as the increase in well annulus pressure is maintained on the well annulus 42. This downward differential is equal to the differential required across annular floating shoe retarding means 676 to overcome the frictional resistance of the inner O-rings 772.

This downward pressure differential, plus the holding force of releasable holding means 600 are greater than the upward biasing force of coil spring 656 and thus will act together to hold power piston 140 in its second position.

OPERATION OF THE EMBODIMENT OF FIGS. 2A–2G

The manner of operation of the tester valve 32 of FIGS. 2A–2G is generally as follows.

The tester valve 32 is initially oriented as illustrated in FIGS. 2A–2G and is made up in the testing string 28 in the position designated by the numeral 32 in FIG. 1.

The tester valve 32 is run down into the well defined by well casing 16 with the ball valve means 90 in its closed position closing the flow passage 92 of the tester valve 32, and with the power piston 140 in its first position illustrated in FIG. 2C.

The resilient biasing means 656 biases the power piston 140 towards its first position.

As the tester valve 32 is run into the well, the increase in hydrostatic pressure in the well annulus fluid with increasing depth is sufficiently balanced across the power piston 140 so that a pressure differential from the first side 142 to the second side 144 of power piston 140 is never sufficient to overcome the resilient biasing means 656 and prematurely move the power piston 140 to its second position. This balancing is accomplished by means of the one-way check valve 704 which allows fluid flow and thus pressure transfer through the second pressure conducting passage means 642 from the balancing port 644 to the second side 144 of power piston 140.

When the tester valve 32 is located in the position designated by the numeral 32 in FIG. 1, the packer means 44 of the testing string is 28 is set against the well casing 16 to separate the well annulus 42 into an upper portion located above the packer means 44 and a lower portion 48 located below the packer means 44.

Both power port 162 and the balancing port 644, and the first and second pressure conducting passage means 160 and 642, are communicated with the upper portion of well annulus 42 above the packer means 44.

The central bore flow passage 92 of the tester valve 32 is communicated with the lower portion 48 of well annulus 42 below the packer means 44.

After the packer means 44 has been set, an increase in annulus fluid pressure is applied to the annulus fluid in the upper portion of well annulus 42 of packer means 44.

This increase in annulus fluid pressure is substantially immediately communicated to the first side 142 of power piston 140 through the first pressure conducting passage means 160.

The increase in annulus fluid pressure is not immediately communicated to the second side 144 of power piston 140, however, because of the time delay action provided by the annular floating shoe retarding means 676. The annular floating shoe retarding means 676 delays communication of a sufficient portion of the increase in annulus fluid pressure to the second side 144 of power piston 140 for a sufficient time to allow a pressure differential from the first side 142 to the second side 144 of power piston 140 to move the power piston 140 to its second position. This delaying is accomplished by means of the inner O-rings 772 of annular floating shoe retarding means 676 which frictionally retard movement of the annular floating shoe retarding means 676 due to their snug engagement with the outer cylindrical surface 774 of lower inner mandrel 750.

Thus a downward pressure differential is created across the power piston 140, and also across the pressure relief means 688.

This downward pressure differential across the pressure relief piston means 688 causes the pressure relief means 688 to move downward to an open position overcoming the biasing effect of spring 698. This downward movement is allowed due to the compressibility of the silicone oil in the second pressure conducting passage means 642 below the pressure relief piston means 688.

When the pressure relief piston means 688 moves downward it opens the pressure relief port 678.

This allows the power piston 140 to move downward from its first position to its second position relieving fluid from the second pressure conducting passage means 642 through the relief port 678, the longitudinal groove 680, and the dump passage 686 into the dump zone 92. The volume of fluid relieved is sufficient to permit the power piston 140 to travel to its second position and is equal to the displacement of the power piston in moving from its first to its second position.

When the power piston 140 moves from its first position to its second position its moves the ball valve means 90 from the closed position illustrated in FIG. 2A to an open position wherein the bore 94 of ball 108 is in alignment with the flow passage central bore 92 of the tester valve 32.

When the power piston 140 reaches its second position, the holding pin is biased by pin biasing means 610 into engagement with the indentation 602 of the operating mandrel 124 thereby releasably holding the power piston 140 in its second position.

With the embodiment of FIGS. 2A–2G, however, it is necessary that the increase in annulus fluid pressure applied to the well annulus 42 be maintained in order to hold the power piston 140 in its second position and hold the ball valve means 190 in its open position.

There are two forces which act together to hold the power piston 140 in this second position. The first is the engagement of the holding pin 604 with the indentation 602. The second is a continuing downward pressure differential across power piston 140 which occurs because of the fact that the annular floating shoe retarding means 676 never completely communicates all of the increase in annulus pressure to the second side 144 of power piston 140.

Due to the frictional engagement of annular floating shoe retarding means 676 with the lower inner mandrel 750, the annular floating shoe retarding means 678 functions much like a back pressure check valve in that it permanently prevents a portion of the increase in annulus fluid pressure from reaching the second side 144 of power piston 140. The amount of pressure which cannot be communicated across annular floating piston retarding means 676, causes a pressure differential of that same amount downward across power piston 140. This downward pressure differential, plus the force required to disengage the holding pin 604 is sufficient to prevent the resilient biasing means 656 from overcoming the force of the holding pin 604 engaging indentation 602 to move the power piston 140 back to its first position.

In order to move the power piston 140 back to its first position, the increase in annulus pressure must be decreased so as to eliminate the downward pressure differential across power piston 140, then the resilient biasing means 656 overcomes the releasable holding force of the holding pin 604 engaging indentation 602, thus disengaging holding pin 604 from indentation 602 and moving power piston 140 back to its upper first position and moving ball valve means 90 to its closed position.

When the power piston 140 moves back upward to its first position, fluid flows through check valve means 704 into the annular cavity 654 to replace the fluid which was lost on the downward stroke of the power piston 140.

If the intermediate floating shoe 720 is not used, the number of times which the tester valve 32 can be cycled between the open and closed positions of the ball valve means 90 is dependent upon the volume of fluid within annular cavity 770 which can be displaced as the annular floating shoe retarding means 676 moves upward in the annular cavity 770. When the upper end of annular floating shoe retarding means 676 engages the lower end of blank cartridge 738, the tester valve 32 must be removed from the well and the annular cavity 770 refilled with fluid.

Sometimes it may be desired to utilize the intermediate floating shoe 720 and fill the second pressure conducting passage means 642 with silicone oil above intermediate floating shoe 720 and a non-compressible oil between intermediate floating shoe 720 and annular floating shoe retarding means 676. Such a situation might arise if a fluid restrictor were used in blank cartridge 738 and there was a problem of foaming of the silicone oil.

If intermediate floating shoe 720 is utilized, then the number of times which the tester valve 32 can be cycled between the open and closed positions of the ball valve means 90 is dependent upon the volume of fluid either in annular cavity 714 above intermediate floating shoe 720 or in annular cavity 770 above annular floating shoe retarding means 676, whichever is lesser.

As previously mentioned, the fluid in the second pressure conducting passage means above the annular floating shoe retarding means 676 is preferably silicone oil. The slight compressibility of the silicone oil allows the pressure relief piston means 688 to move downward to its open position. The silicone oil is not compressible enough, however, to allow the power piston 140 to move downward, without having the oil relieved to the dump zone 92.

Thus, it is seen that the methods and apparatus of the present invention readily achieve the ends and advantages mentioned as well as those inherent therein. While certain preferred embodiments of the present invention have been illustrated for the purposes of the present disclosure, numerous changes in the arrangement and construction of parts may be made by those skilled in the art which changes are encompassed within the scope and spirit of the present invention as defined by the appended claims.

What is claimed is:

1. An annulus pressure responsive downhole tool apparatus, comprising:

a tool housing;

a power piston slidably disposed in said housing;

a first pressure conducting passage means for communicating a well annulus with a first side of said power piston;

a second pressure conducting passage means for communicating said well annulus with a second side of said power piston;

said tool housing including inner and outer concentric tubular members defining an annular cavity therebetween, said second pressure conducting passage means being at least partially defined by said annular cavity;

retarding means, disposed in said second pressure conducting passage means, for delaying communication of a sufficient portion of an increase in well annulus pressure to said second side of said power piston for a sufficient time to allow a pressure differential from said first side to said second side of said power piston to move said power piston from a first position to a second position relative to said housing, said retarding means including an annular floating shoe closely received in said annular cavity, said floating shoe including resilient friction means snugly engaging both said inner and outer tubular members of said tool housing; and pressure relief means, communicated with a first portion of said second pressure conducting passage means between said second side of said piston and said retarding means, for relieving from said first portion of said second pressure conducting passage means a volume of fluid sufficient to permit said power piston to travel to its said second position.

2. The apparatus of claim 1, wherein:

said resilient friction means includes more than two resilient O-rings snugly engaging one of said inner and outer concentric tubular members.

3. The apparatus of claim 2, wherein:

said more than two resilient O-rings snugly engage said inner tubular member.

4. The apparatus of claim 1, wherein:

said floating shoe of said retarding means is further characterized as also being a means for allowing an additional portion of said increase in well annulus pressure to be communicated to said second side of said power piston after said power piston is moved to its said second position.

5. The apparatus of claim 1, wherein:

said first portion of said second pressure conducting passage means is filled with a first fluid that is sufficiently incompressible such that said power piston would be hydraulically blocked from travelling to its said second position unless said volume of said first fluid were relieved from said first portion of said second pressure conducting passage means by said pressure relief means.

6. The apparatus of claim 1, further comprising:

resilient biasing means, operatively associated with said power piston, for biasing said power piston toward its said first position.

7. The apparatus of claim 1, further comprising:

run-in balance means for allowing well annulus pressure to sufficiently balance across said power piston as said apparatus is run into said well so that a pressure differential from said first side to said second side of said power piston is never sufficient to prematurely move said power piston to its said second position when said apparatus is being run into said well.

8. The apparatus of claim 7, wherein:

said second pressure conducting passage means includes a bypass portion bypassing said pressure relief means; and said run-in balance means includes check valve means, disposed in said bypass portion, for allowing fluid flow and thus pressure transmission in a first direction from said well annulus through said bypass portion of said second pressure conducting passage means to said second side of said power piston, and for preventing fluid flow in a reverse direction opposite of said first direction.

9. The apparatus of claim 1, further comprising:

releasable holding means, operatively associated with said power piston, for releasably preventing said power piston from returning to its first position.

10. The apparatus of claim 9, wherein said releasable holding means includes:

an indentation disposed in an actuating mandrel attached to said power piston;

a holding pin radially slidably disposed in a radial bore of said tool housing;

resilient pin biasing means for biasing said holding pin radially inward relative to said housing; and wherein said indentation and said pin are so arranged and constructed that when said power piston is in its said second position said indentation is aligned with said pin so that said pin is moved into said indentation by said pin biasing means so that said power iston is releasably held in its said second position.

11. The apparatus of claim 1, wherein:

said first portion of said second pressure conducting passage means contains a sufficient volume of fluid that said apparatus may be operated multiple times to repeatedly move said power piston from its first position to its second position without refilling said first portion of said second pressure conducting passage means with fluid.

12. The apparatus of claim 1, wherein said pressure relief means includes:

a relief housing;

a relief port, disposed through said relief housing, and communicating said first portion of said second pressure conducting passage means with a fluid dump zone;

a pressure relief piston means, slidably disposed in said relief housing and movable between a first position wherein said relief port is closed and a second position wherein said relief port is open; and resilient relief piston biasing means for biasing said relief piston toward its said first position.

13. An annulus pressure responsive downhole tool apparatus, comprising:

a tool housing;

a power piston slidably disposed in said housing;

a first pressure conducting passage means for communicating a well annulus with a first side of said power piston;

a second pressure conducing passage means for communicating said well annulus with a second side of said power piston;

said tool housing including inner and outer concentric tubular members defining an annular cavity therebetween, said second pressure conducting passage means being at least partially defined by said annular cavity;

retarding means, disposed in said second pressure conducting passage means, for delaying communication of a sufficient portion of an increase in well annulus pressure to said second side of said power piston for a sufficient time to allow a pressure differential from said first side to said second side of said power piston to move said power piston from a first position to a second position relative to said housing, said retarding means including a floating shoe closely received in said annular cavity, said floating shoe including friction means snugly engaging both said inner and outer tubular members of said tool housing; and pressure relief means, communicated with a first portion of said second pressure conducting passage means between said second side of said power piston and said retarding means, for relieving from said first portion of said second pressure conducting passage means a volume of fluid sufficient to permit said power piston to travel to its said second position; and releasable holding means, operatively associated with said power piston, for releasably preventing said power piston from returning to its first position, said releasable holding means including; indentation disposed in an actuating mandrel attached to said power piston;

a holding pin radially slidably disposed in a radial bore of said tool housing;

resilient pin biasing means for biasing said holding pin radially inward relative to said housing; and wherein said indentation and said pin are so arranged and constructed that when said power piston is in its said second position said indentation is aligned with said pin so that said pin is moved into said indentation by said pin biasing means so that said power piston is releasably held in its said second position.

14. A method of operating an annulus pressure responsive downhole tool of the type including a power piston slidably disposed in a housing, a valve means operatively associated with said power piston, first and second pressure conducting passages communicating an annulus of a well with first and second sides of said power piston, and a pressure relief means disposed in said second pressure conducting passage, said power piston being movable between first and second positions relative to said housing and corresponding to closed and open positions, respectively, of said valve means, said method comprising the steps of:

running said tool down into said well with said valve means in its said closed position closing a flow passage of said valve means, and with said power piston in its said first position;

resiliently biasing said power piston toward its said first position with a resilient biasing means;

sufficiently balancing well annulus pressure across said power piston as said tool is run into said well so that a pressure differential from said first side to said second side of said power piston is never sufficient to overcome said resilient biasing means and prematurely move said power piston to its second position as said tool is being run into said well;

setting a packer means, connected to said tool, in said well to separate said well annulus into upper and lower portions, said first and second pressure conducting passages being communicated with said upper portion, and said flow passage of said valve means being communicated with said lower portion of said well annulus;

applying an increase in annulus fluid pressure to an annulus fluid in said upper portion of said well annulus;

communicating said increase in annulus fluid pressure to said first side of said power piston through said first pressure conducting passage;

delaying communication of a sufficient portion of said increase in annulus fluid pressure to said second side of said power piston a sufficient time to allow a pressure differential from said first side to said second side of said power piston to move said power piston to its said second position, said delaying being accomplished by placing an annular floating shoe in an annular portion of said second pressure conducting passage defined in said housing, and by frictionally retarding movement of said annular floating shoe by means of a plurality of resilient O-rings disposed in grooves of said annular floating shoe, said O-rings snugly engaging a wall of said housing, said wall partially defining said annular portion of said second pressure conducting passage;

opening said pressure relief means during said time of delayed communication;

moving said power piston from its first position to its second position;

relieving from said second pressure conducting passage, as said power piston moves from its first position to its second position, a volume of fluid sufficient to permit said power piston to travel to its said second position; and thereby moving said valve means to its said open position opening said flow passage of said valve means as said power piston is moved to its said second position.

15. The method of claim 14, wherein said flow passage of said valve means is a central bore of said tool.

16. The method of claim 15, wherein:

said relieving step is further characterized as relieving said volume of fluid into said central bore of said tool.

17. The method of claim 15, further comprising the step of:

allowing, due to movement of said annular floating shoe toward said second side of said power piston, an additional portion of said increase in annulus fluid pressure to be communicated to said second side of said power piston after said power piston is moved to its said second position.

18. The method of claim 15, further comprising the step of:

releasably preventing said power piston from returning to its first position, by mens of a releasable holding means.

19. The method of claim 18, wherein:

said releasably preventing step is accomplished by engaging a spring biased pin connected to said housing with an indentation disposed in an actuating mandrel attached to said power piston.

20. The method of claim 14, further comprising the steps of:

applying a decrease in annulus fluid pressure to said annulus fluid in said upper portion of said well annulus;

communicating said decrease in annulus fluid pressure to said first side of said power piston through said first pressure conducting passage;

returning said power piston to its said first position by means of said resilient biasing means;

thereby moving said valve means to its said closed position closing said flow passage of said valve means; and bypassing fluid through said second pressure conducting passage past said pressure relief means to said second side of said piston, as said piston returns to its said first position.

* * * * *